US009564718B2

(12) United States Patent
Li

(10) Patent No.: US 9,564,718 B2
(45) Date of Patent: Feb. 7, 2017

(54) POWER PLUG AND POWER RECEPTACLE WITH OVER-TEMPERATURE PROTECTION FUNCTION

(71) Applicant: Chengli Li, Suzhou (CN)

(72) Inventor: Chengli Li, Suzhou (CN)

( * ) Notice: Subject to any disclaimer, the term of this patent is extended or adjusted under 35 U.S.C. 154(b) by 0 days.

(21) Appl. No.: 14/557,011

(22) Filed: Dec. 1, 2014

(65) Prior Publication Data

US 2016/0141812 A1 May 19, 2016

(30) Foreign Application Priority Data

Nov. 17, 2014 (CN) ..... 2014 1 0655061
Nov. 17, 2014 (CN) ..... 2014 2 0688329 U

(51) Int. Cl.

| | |
|---|---|
| ***H01R 13/713*** | (2006.01) |
| ***H01R 24/30*** | (2011.01) |
| ***H01R 24/78*** | (2011.01) |
| ***H01R 25/00*** | (2006.01) |
| *H01R 103/00* | (2006.01) |

(52) U.S. Cl.

CPC ..... *H01R 13/7137* (2013.01); *H01R 24/30* (2013.01); *H01R 24/78* (2013.01); *H01R 25/006* (2013.01); *H01R 2103/00* (2013.01)

(58) Field of Classification Search

USPC ..... 439/620.21; 361/103, 105, 107, 49, 93, 361/42

See application file for complete search history.

(56) References Cited

U.S. PATENT DOCUMENTS

| | | | | |
|---|---|---|---|---|
| 3,872,355 | A * | 3/1975 | Klein et al. | 361/45 |
| 4,310,837 | A * | 1/1982 | Kornrumpf et al. | 340/598 |
| 4,470,711 | A * | 9/1984 | Brzozowski | 374/179 |
| 4,816,958 | A * | 3/1989 | Belbel | H01H 33/161 361/11 |
| 5,600,306 | A * | 2/1997 | Ichikawa et al. | 340/584 |
| 5,862,030 | A | 1/1999 | Watkins et al. | |
| 5,930,097 | A * | 7/1999 | Ceola et al. | 361/103 |
| 5,966,281 | A * | 10/1999 | Larson | H01H 71/123 361/103 |
| 6,161,958 | A * | 12/2000 | Rattman et al. | 374/1 |
| 6,552,888 | B2 * | 4/2003 | Weinberger | 361/57 |
| 6,707,652 | B2 * | 3/2004 | Engel | 361/42 |
| 7,508,642 | B2 * | 3/2009 | Ye | 361/103 |
| 8,325,454 | B2 * | 12/2012 | Brugner et al. | 361/103 |
| 2007/0139842 | A1 | 6/2007 | De Longhi | |

* cited by examiner

*Primary Examiner* — Alexander Gilman
(74) *Attorney, Agent, or Firm* — Chen Yoshimura LLP

(57) ABSTRACT

An electrical power plug or receptacle with an over-temperature protection function, including a reset switch operated by a solenoid that electrically connects and disconnects the input side and output side electrical lines, and an temperature-controlled switch disposed in thermal contact with one or more electrical conductor plates on the input or output side. The temperature-controlled switch is connected in series with the solenoid between the output side phase and neutral lines. When the temperature of the temperature-controlled switch is within a normal range, the switch is open and does not form a current path with the solenoid. When the temperature is at or above a threshold temperature, the temperature-controlled switch is closed, a current flows through the switch and the solenoid between the output side phase and neutral lines, and the solenoid operates the reset switch to disconnect the input side from the output side.

5 Claims, 5 Drawing Sheets

C-C

POWER PLUG AND POWER RECEPTACLE WITH OVER-TEMPERATURE PROTECTION FUNCTION

BACKGROUND OF THE INVENTION

Field of the Invention

This invention relates to electrical power plugs and receptacles, and in particular, it relates to power plugs and receptacles that have a protection devices coupled to the conductor plates of the plug and receptacle.

Description of the Related Art

Electrical power plugs and receptacles are widely used in everyday life for connecting to electrical appliances. The electrical contact components such as plates or plates of plugs and receptacles are typically made of copper alloys, and their exterior housings use plastic materials for insulation. Typically, the receptacle is mounted in the wall, and the plug is connected to an appliance or another board having multiple receptacles. During long term use, the contact plates of the receptacle may lose their resilience so the contact between the contact plates of the receptacle and the plug may be affected, the receptacle or plug may be affected by humidity, or over-current conditions may occur during use. In certain conditions, the copper alloy plates may generate a high temperature, which may melt the insulating housing of the receptacle and cause fire. Similarly, in overload conditions, the copper alloy plates of the receptacles can generate a high temperature, and the contact plates of the plug are also at high temperature, which may melt the insulating housing of the plug and cause fire and damage.

SUMMARY OF THE INVENTION

To solve the above problems, the present invention provides a protection device which can prevent over-temperature and fire hazard caused by poor electrical contact or over-current conditions.

In one aspect, the present invention provides an electrical power plug or receptacle having an over-temperature protection function, which includes: input side phase and neutral lines and output side phase and neutral lines; a reset switch for electrically connecting and disconnecting the input side phase and neutral lines and the output side phase and neutral lines; a solenoid mechanically couplet to the reset switch, wherein when a current flows through the solenoid, the solenoid operates the reset switch to disconnect the input side phase and neutral lines from the output side phase and neutral lines; two or more electrical conductor plates, include at least a phase plate and a neutral plate, electrically coupled respectively to either the input side phase and neutral lines or the output side phase and neutral lines; and at least one temperature-controlled switch, disposed in direct or indirect thermal contact with at least one of the electrical conductor plates, wherein the temperature-controlled switch is electrically connected in series with the solenoid between the output side phase and neutral lines, and wherein the temperature-controlled switch is in an open state when its temperature is below a predetermined threshold temperature and in a closed state when its temperature is at or above the predetermined threshold temperature, wherein when the temperature of the temperature-controlled switch is at or above the predetermined threshold temperature, the temperature-controlled switch is closed, a current flows through the temperature-controlled switch and the solenoid between the output side phase and neutral lines, and the solenoid operates the reset switch to disconnect the input side phase and neutral lines from the output side phase and neutral lines.

The power plug or receptacle devices according to embodiments of the present invention provide temperature-controlled switch disposed on a side of the contact plates on the input side of the plug or the output side of the receptacle, for detecting the temperature of the contact plates in real time, and quickly disconnect the input side and output side when the temperature is above a threshold temperature, to ensure safety.

BRIEF DESCRIPTION OF THE DRAWINGS

By referring to the embodiments described below with reference to the drawings, the present invention can be understood along with other objectives, specifics, characteristics and advantages. In the drawings.

DETAILED DESCRIPTION OF THE PREFERRED EMBODIMENTS

Figure 1A:
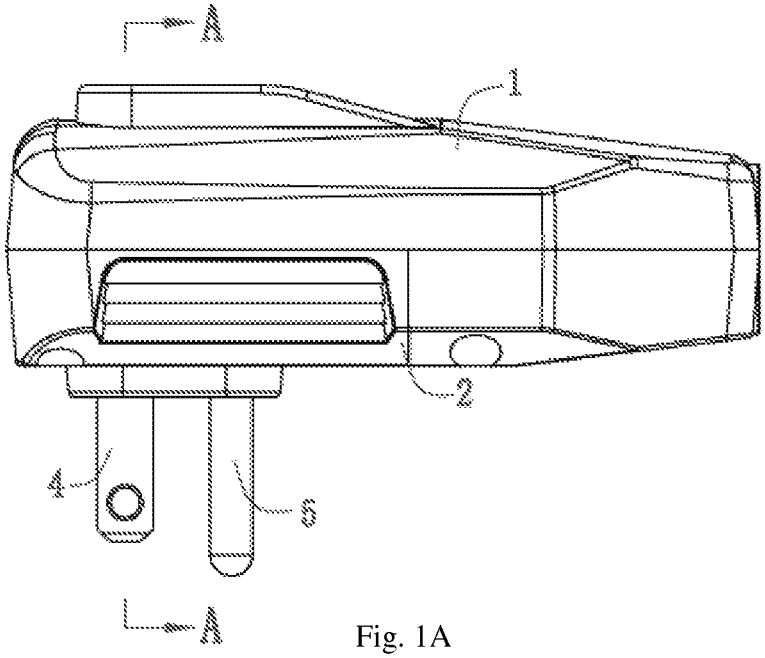
FIG. 1A illustrate an exterior view of an electrical power plug according to an embodiment of the present invention.
Figure 1B:
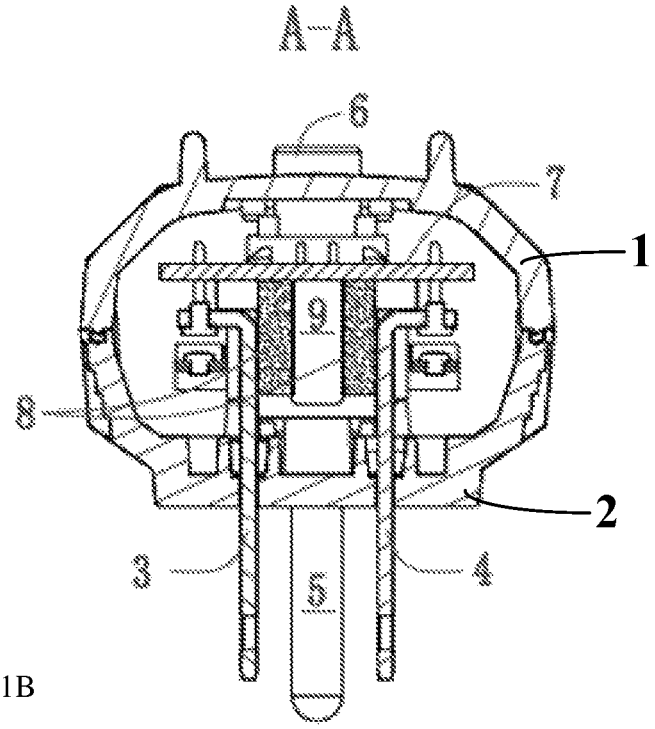
FIG. 1B illustrates a cross-sectional view of the cross-section A-A of the plug shown in FIG. 1A.
Figure 2A:
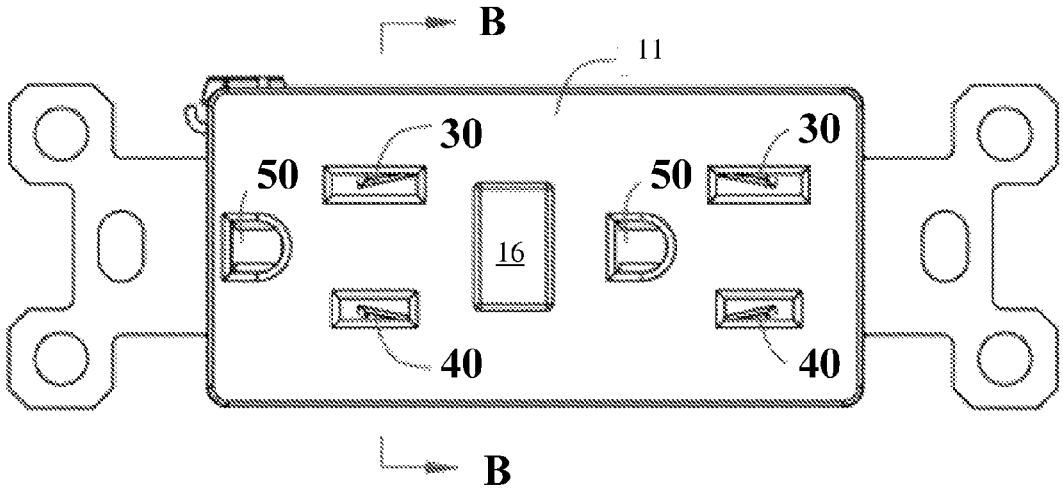
FIG. 2A illustrate an exterior view of an electrical power receptacle according to an embodiment of the present invention.
Figure 2B:
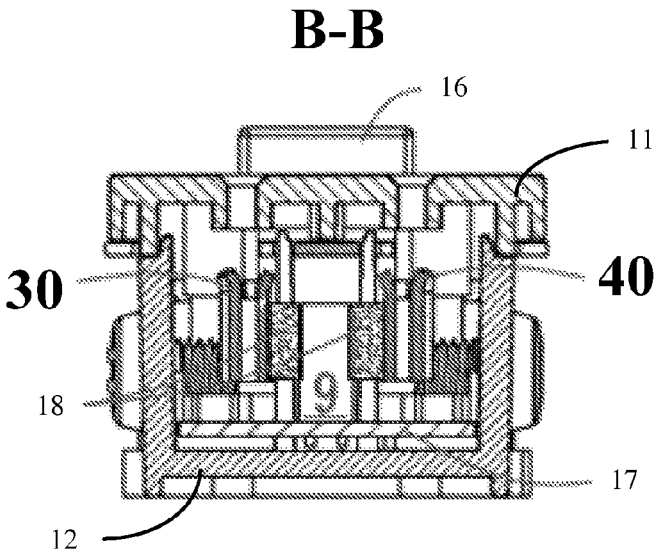
FIG. 2B illustrates a cross-sectional view of the cross-section A-A of the receptacle shown in FIG. 2A.

The preferred embodiments of the present invention are described in detail below with reference to the drawings. Although the preferred embodiments are shown in the drawings, it should be understood that the invention can be realized in various ways and is not limited to the embodiments described here. Instead, these embodiments are provided to make the disclosure more thorough and complete, and to convey the disclosure to those skilled in the art.

Figure 3A:
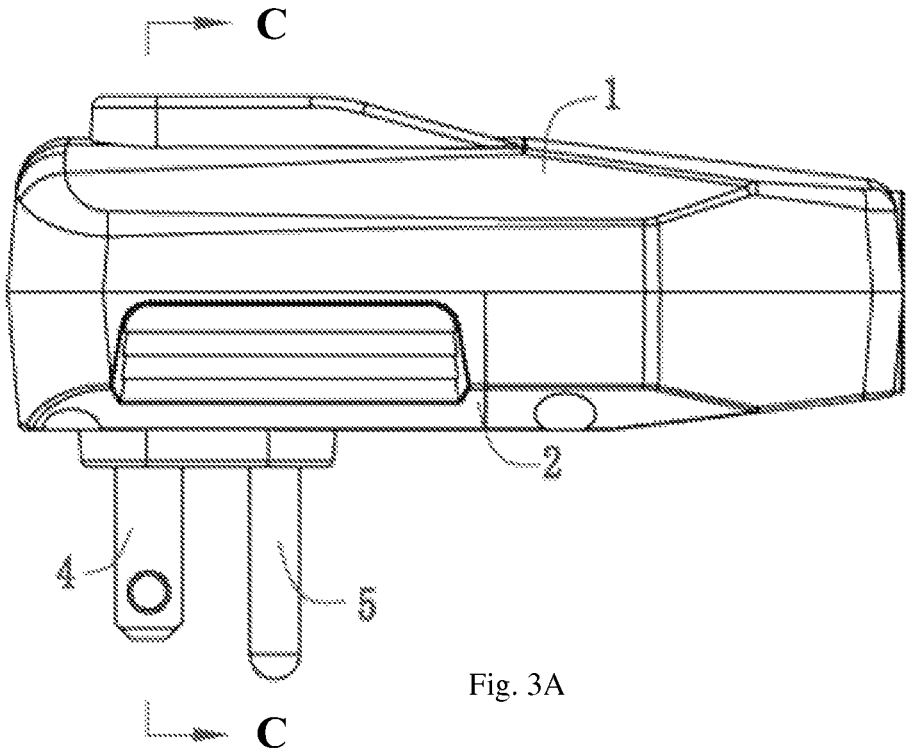
FIG. 3A illustrate an exterior view of an electrical power plug according to an embodiment of the present invention.
Figure 3B:
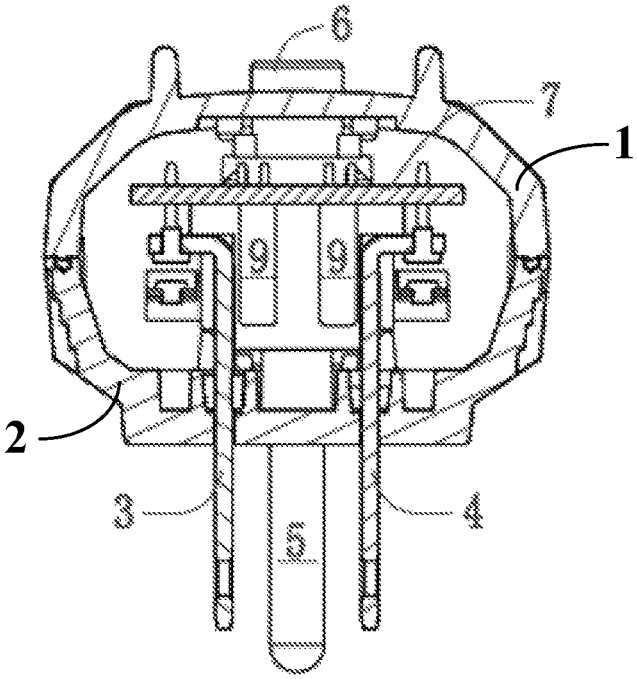
FIG. 3B illustrates a cross-sectional view of the cross-section A-A of the plug shown in FIG. 1A.
Figure 4A:
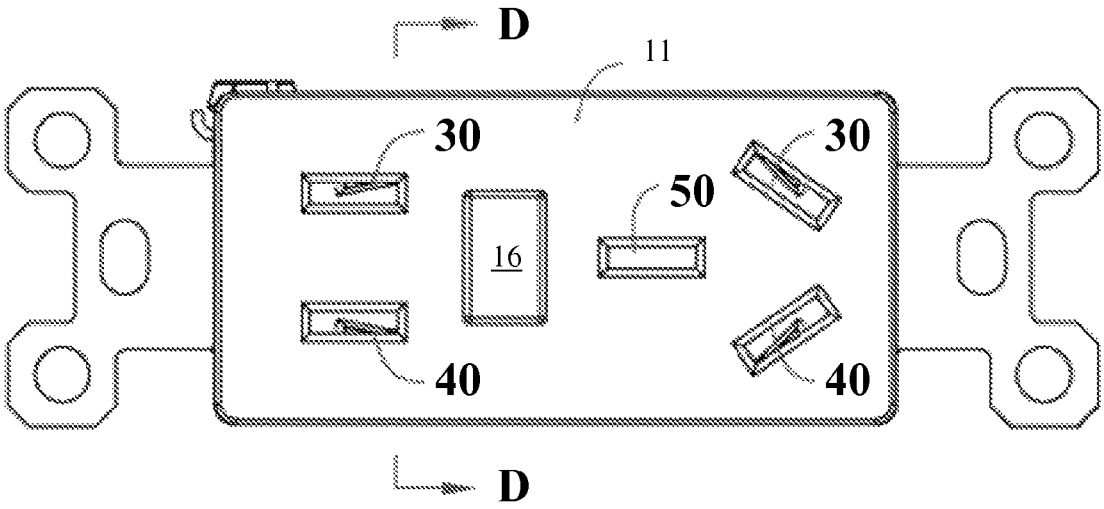
FIG. 4A illustrate an exterior view of an electrical power receptacle according to an embodiment of the present invention.
Figure 4B:
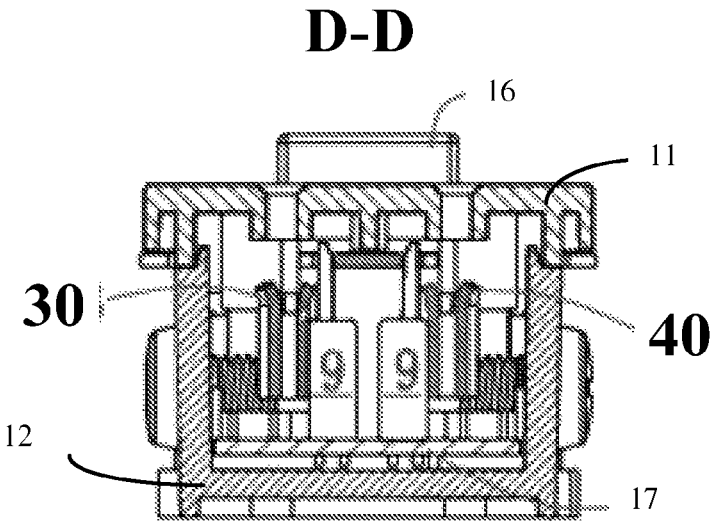
FIG. 4B illustrates a cross-sectional view of the cross-section A-A of the receptacle shown in FIG. 2A.

A power plug with over-temperature protection according to embodiments of the present invention is described with reference to FIGS. 1A-1B, 3A-3B and 5. The power plug has an insulating housing that includes an upper housing 1 and a lower housing 2. A control circuit board 7 is disposed inside the insulating housing and is electrically coupled to a trip mechanism. A reset button 6 protrudes out of the upper housing 1 and is connected to a reset switch 10 (FIG. 5) to form a reset switch assembly RESET. The input electrical conductor plates include a neutral plate 3 and a phase plate 4, and optionally includes a ground plate 5. In the embodiment shown in FIGS. 1A-1B, a temperature-controlled switch 9 is disposed between the neutral plate 3 and the phase plate 4, to monitor the temperature of these plates in real time. While this illustrated embodiment shows one temperature-controller switch between the input conductor plates, those skilled in the art will recognize that depending on practical considerations, it is possible to employ one or more temperature-controlled switches disposed on one or more sides of the input conductor plates. Preferably, to quickly and accurately monitor the temperature of the input conductor plates, thermally conducting plates 8 made of materials of high thermal conductivity (e.g. metal or non-metal materials) may be disposed between the temperature-controlled switch 9 and the neutral plate 3 and a phase plate 4, respectively. The temperature-controlled switch 9 can also be disposed directly adjacent respective input conductor plates. For example, as shown in FIGS. 3A-3B, two temperature-controlled switches 9 are provided, and the thermally conducting plates 8 are omitted.

FIGS. 2A-2B and 4A-4B illustrate power receptacles with over-temperature protection according to embodiments of the present invention. The insulating housing of the receptacles includes an upper housing 11 and a lower housing 12. A control circuit board 17 is disposed inside the insulating housing and is electrically coupled to a trip mechanism. The output conductor plates include neutral plates 30 and phase plates 40 (typically, each being a pair of plates), and optionally includes ground plates 50. Similar to the power plug described earlier, a temperature-controlled switch 9 is disposed between the neutral plates 30 and the phase plate 40. Thermally conducting plates 18 may be disposed between the temperature-controlled switch 9 and the neutral plate 30 and a phase plate 40 (see FIGS. 2A-2B), or they can be omitted (see FIGS. 4A-4B).

In use, the operating principles of the power plug and receptacles of the above embodiments are essentially the same. The temperature monitoring process is described below with reference to FIG. 5, using a power plug with thermally conducting plates as an example.

Figure 5:
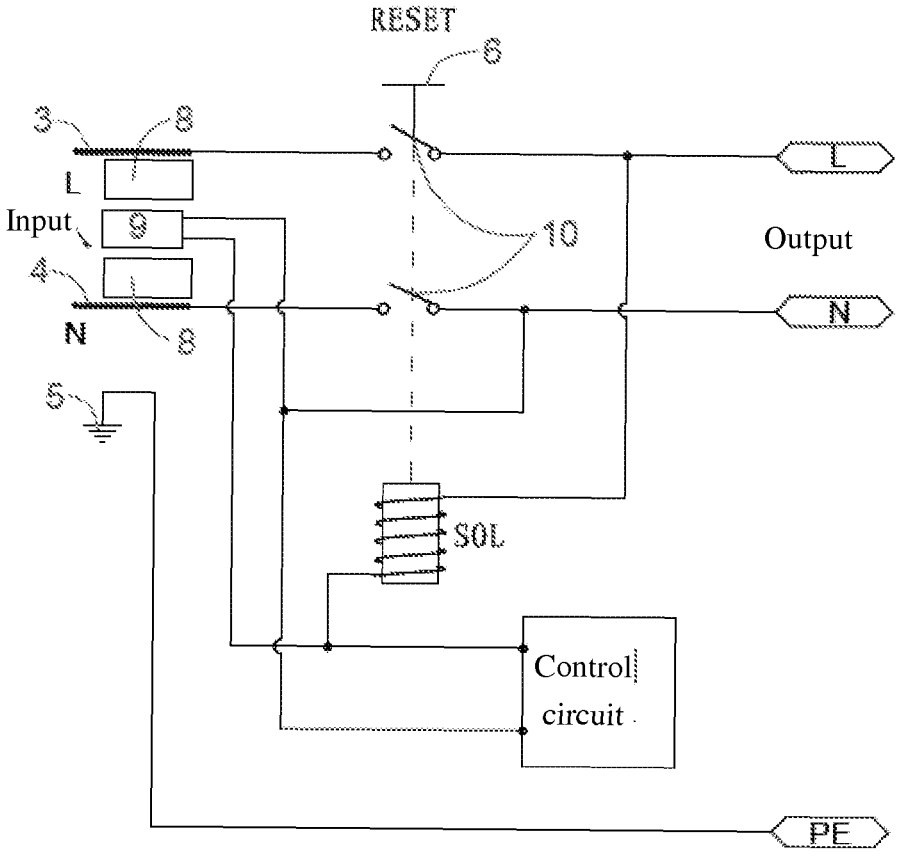
FIG. 5 illustrates a circuit of power a plug or receptacle according to an embodiment of the present invention.

As shown in FIG. 5, the reset switch 10 can electrically connect or disconnect the output (load) side phase and neutral lines and the input (source) side phase and neutral lines. The reset switch 10 is mechanically couplet to a solenoid SOL. When the solenoid is energized, it generates a mechanical force to open the reset switch 10 to disconnect the input and output sides. The control circuit 7 may be one that can detect a ground fault or leakage current or other fault conditions and cause the solenoid to be energized to disconnect the output side and the input side. Such control circuits are generally known in the art. In a preferred embodiment, the over-temperature protection operation described below is independent of the operation of the control circuit 7, while they both utilize the solenoid SOL.

The temperature-controlled switch 9 has an open state and a closed state, and is normally open. In other words, it is in the open state (i.e. non-conducting) when its temperature is below a predetermined threshold temperature and in the closed state (i.e. conducting) when its temperature is above the threshold temperature. The switch 9 is connected in series with the solenoid SOL between the output phase and neutral lines. In one embodiment, no other electrical elements are connected on this current path.

The temperature-controlled switch may include two metal strips that are either in contact with each other or separated form each other based on their temperature.

During normal use, when the temperature of the output neutral conductor plate 3 and output phase conductor plate 4 are within the normal range, the temperature of the thermally conducting plates 8 is at or below the temperature of the neutral plate 3 and a phase plate 4, so the temperature of the temperature-controlled switch 9 is below a predetermined threshold temperature. Thus, the temperature-controlled switch 9 is open, and no current flows through the solenoid (assuming no other fault condition exists), and the plug can be used normally. On the other hand, when abnormal conditions cause the temperature of the output neutral conductor plate 3 and/or output phase conductor plate 4 to rise above the normal range, the temperature of the thermally conducting plates 8 rises accordingly, so the temperature of the temperature-controlled switch 9 is at or above the predetermined threshold temperature. The temperature-controlled switch 9 becomes closed, forming a current path through the serial-connected solenoid and switch 9. As a result, the solenoid is energized, causing the reset switch to be open, thereby disconnecting the output side and the input side. Thereafter, if the user resolves the abnormal condition, and presses the reset button 6, the reset switch 10 can be reset and the plug can be used again.

Referring to FIG. 5, if the electrical device is a receptacle, the input and output sides will be the reverse of that shown in FIG. 5, and the current path formed by the switch 9 and the solenoid SOL will be connected across the phase and neutral lines on the output side (i.e. the same side as the conductor plates 3 and 4).

If two or more temperature-controlled switches are employed, they are connected in parallel and then connected in series with the solenoid SOL. Therefore, when any such switch is closed due to an over-temperature condition, the solenoid will be energized.

Those skilled in the art should appreciate that the above descriptions are illustrative only and do not limit the scope of the present invention. Those skilled in the art should also appreciate that the various exemplary logic units, modules, circuits and algorithms described in the embodiments can be implemented in hardware or software or their combination. To clearly illustrate the interchangeability of hardware and software, the various exemplary parts, components, modules, circuits and method steps are described using functional descriptions. Whether the functions are implemented in hardware or software depends on the particular applications and design limitations of the system. Those skilled in the art can implement the above described functions using various modifications for particular applications, and such implementation decisions are within the scope of the invention.

What is claimed is:

1. An electrical device, being either a power plug or a receptacle, having an over-temperature protection function, comprising:

input side phase and neutral lines and output side phase and neutral lines;

a reset switch for electrically connecting and disconnecting the input side phase and neutral lines and the output side phase and neutral lines;

a solenoid mechanically couplet to the reset switch, wherein when a current flows through the solenoid, the solenoid operates the reset switch to disconnect the input side phase and neutral lines from the output side phase and neutral lines;

two or more electrical conductor plates, include at least a phase plate and a neutral plate, electrically coupled respectively to either the input side phase and neutral lines or the output side phase and neutral lines;

at least one temperature-controlled switch, disposed in direct or indirect thermal contact with at least one of the electrical conductor plates, the temperature-controlled switch including two metal strips that are either in contact with each other or separated form each other based on their temperature, wherein the temperature-controlled switch is electrically connected in series with the solenoid between the output side phase and neutral lines, and wherein the temperature-controlled switch is in an open state when its temperature is below a predetermined threshold temperature and in a closed state when its temperature is at or above the predetermined threshold temperature, wherein when the temperature of the temperature-controlled switch is at or above the predetermined threshold temperature, the temperature-controlled switch is closed, a current flows through the temperature-controlled switch and the solenoid between the output side phase and neutral lines, and the solenoid operates the reset switch to disconnect the input side phase and neutral lines from the output side phase and neutral lines; and thermally conductive materials disposed between the temperature-controlled switch and the phase plate and between the temperature-controlled switch and the neutral plate.

2. The electrical device of claim 1, wherein the thermally conductive materials are metal or non-metal materials having high thermal conductivity.

3. The electrical device of claim 1, further comprising:

an insulating housing; and a control circuit board disposed inside the insulating housing, the control circuit board being electrically connected to the solenoid, for detecting a fault condition and operating the solenoid when detecting the fault condition.

4. The electrical device of claim 1, being a power plug, wherein the two or more electrical conductor plates are electrically coupled respectively to the input side phase and neutral lines.

5. The electrical device of claim 1, being a receptacle, wherein the two or more electrical conductor plates are electrically coupled respectively to the output side phase and neutral lines.

* * * * *